US007479863B2

(12) United States Patent
Kit et al.

(10) Patent No.: US 7,479,863 B2
(45) Date of Patent: Jan. 20, 2009

(54) JOINTLESS WINDINGS FOR TRANSFORMERS

(75) Inventors: Checky Chow Chi Kit, Hong Kong (HK); Kelvin So Wing Chi, Hong Kong (HK); Francois Lai Chung Hang, Hong Kong (HK)

(73) Assignee: Astec International Limited, Kwun Tong, Kowloon (HK)

( * ) Notice: Subject to any disclaimer, the term of this patent is extended or adjusted under 35 U.S.C. 154(b) by 355 days.

(21) Appl. No.: 11/396,425

(22) Filed: Mar. 31, 2006

(65) Prior Publication Data

US 2007/0229206 A1 Oct. 4, 2007

(51) Int. Cl.
*H01F 5/00* (2006.01)

(52) U.S. Cl. ..... 336/200; 336/223; 336/232; 29/602.1

(58) Field of Classification Search ..... 336/200, 336/223, 232; 29/602.1, 605–606
See application file for complete search history.

(56) References Cited

U.S. PATENT DOCUMENTS

| | | | | |
|---|---|---|---|---|
| 4,665,357 | A | 5/1987 | Herbert | |
| 5,804,892 | A * | 9/1998 | Schwan et al. | 307/104 |
| 6,194,987 | B1 * | 2/2001 | Zhou et al. | 336/200 |
| 6,204,745 | B1 | 3/2001 | Liu et al. | |
| 6,377,157 | B1 | 4/2002 | Liu et al. | |
| 6,577,220 | B2 | 6/2003 | Liu et al. | |
| 6,798,326 | B2 * | 9/2004 | Iida | 336/200 |
| 6,816,020 | B2 * | 11/2004 | Wood | 331/57 |

FOREIGN PATENT DOCUMENTS

JP 4196507 7/1992

OTHER PUBLICATIONS

Broadband TelCom Power, Inc.: www.btcpower.com; FMTX Technology; 14 pgs.

* cited by examiner

*Primary Examiner*—Anh T Mai
(74) *Attorney, Agent, or Firm*—Harness, Dickey & Pierce, P.L.C.

(57) ABSTRACT

A transformer includes at least two windings. Each winding has at least one turn, and the windings are configured from a loop of electrically conductive material.

22 Claims, 6 Drawing Sheets

JOINTLESS WINDINGS FOR TRANSFORMERS

FIELD

The present disclosure relates to windings for a transformer and more specifically, windings configured from a single piece of electrically conductive material.

BACKGROUND

The statements in this section merely provide background information related to the present disclosure and may not constitute prior art.

Windings for transformers are sometimes are created by folding and soldering multiples strips of electrically conductive material. The points at which the strips are soldered together are known as solder joints.

Windings having solder joints present several disadvantages. For example, current flowing through a solder joint typically encounters higher electrical resistivity than in parts of the winding not having solder joints. Higher electrical resistivity leads to increased power loss resulting in poorer performance of the winding. In addition, solder joints add complexity and cost to the manufacturing process of these windings.

SUMMARY

To solve these and other needs, the present inventors have succeeded at designing, among other things, a winding configured from a loop of electrically conductive material.

According to one aspect of the present disclosure, a transformer includes at least two windings. Each winding has at least one turn, and the windings are configured from a loop of electrically conductive material.

According to another aspect of the present disclosure, a matrix transformer includes a primary winding and a secondary winding. At least one of the windings configured from a single loop of electrically conductive material.

According to yet another aspect of the present disclosure, a planar matrix transformer includes a primary winding formed on printed circuit board and a secondary winding. The secondary winding is configured from a loop of electrically conductive material, and is free of solder joints. The primary and secondary windings together form a part of a planar matrix transformer.

According to still another aspect of the present disclosure, a planar matrix transformer includes a first transformer having a primary and a secondary winding, and a second transformer having a primary and a secondary winding. Each primary winding is formed on printed circuit board and each secondary winding has two turns and is configured from a single loop of electrically conductive material.

In accordance with yet another aspect of the present invention, a method of making a winding for a matrix transformer, the method includes providing a loop of electrically conductive material, and folding the loop to form at least two windings for a matrix transformer.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 1 is a perspective view of a loop of electrically conductive material according to one embodiment of the present disclosure.

FIGS. 2A-D illustrates a series of folding steps for configuring the loop of FIG. 1 into a winding.

DETAILED DESCRIPTION

Figure 1:
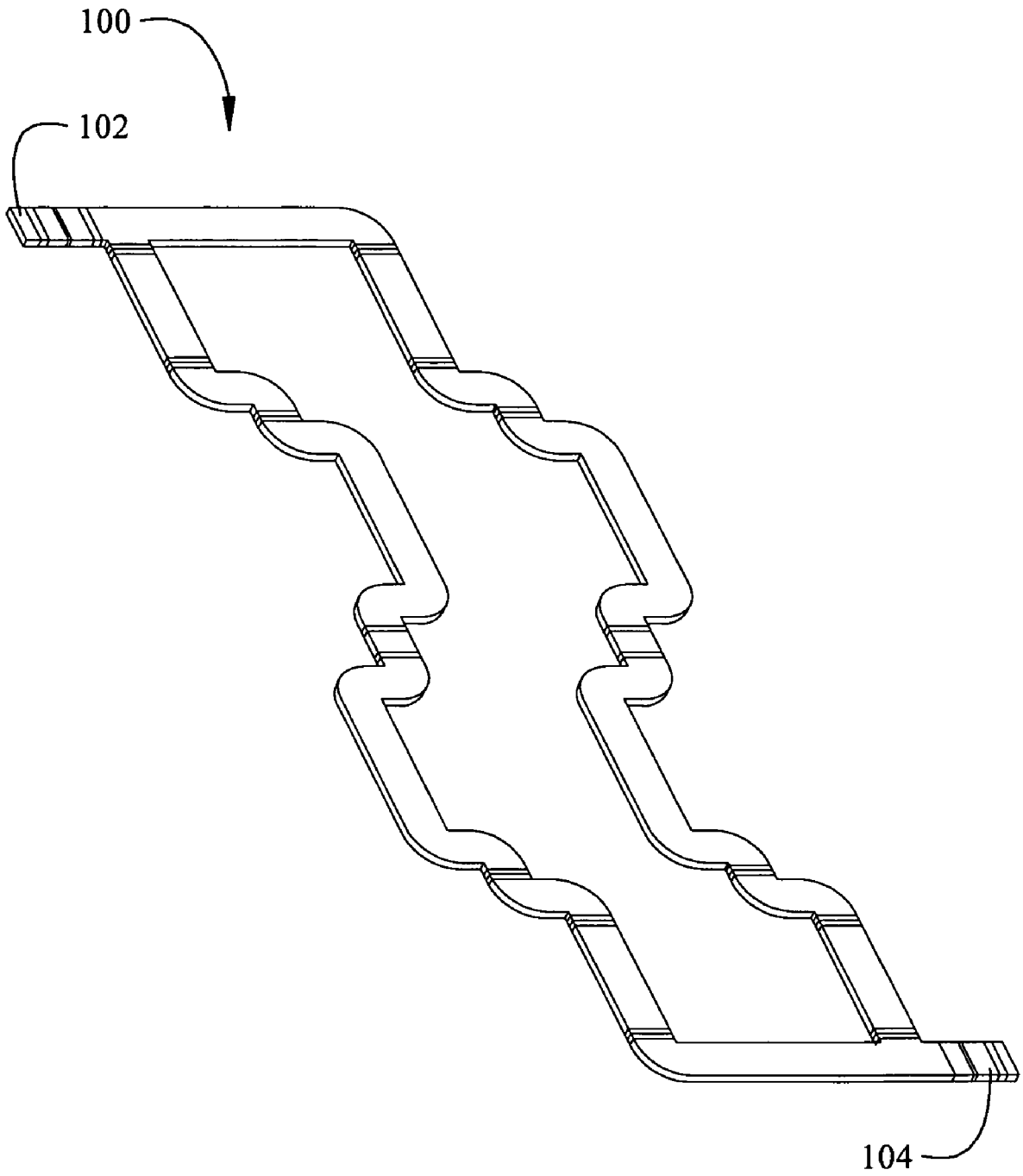

Illustrative embodiments of the present invention are described below. In the interest of clarity, not all features of an actual implementation are described in this specification. It will be appreciated that in the development of any actual embodiment, numerous implementation-specific decisions must be made to achieve specific goals, such as performance objectives and compliance with system-related, business-related and/or environmental constraints. Moreover, it will be appreciated that such development efforts may be complex and time-consuming, but would nevertheless be a routine undertaking for those of ordinary skill in the art having the benefit of this disclosure.

According to one embodiment of the present disclosure, a transformer comprises at least two windings. Each winding has at least one turn and the windings are configured from a jointless loop of electrically conductive material.

An exemplary loop of electrically conductive material indicated generally by reference numeral 100 incorporating the windings of the embodiment described immediately above will now be described with reference to FIG. 1. The loop 100 is formed from a single piece of electrically conductive material. In addition, the loop 100, in one aspect, may include tabs 102 and 104.

The loop 100 is free of solder joints and may be configured into a primary or a secondary transformer winding. Configuring the loop into a winding is described in more detail below. Since the loop 100 is free of solder joints, windings configured from the loop 100 have lower electrical resistivity and are also easier and less expensive to manufacture than known windings having solder joints.

Figure 2A:
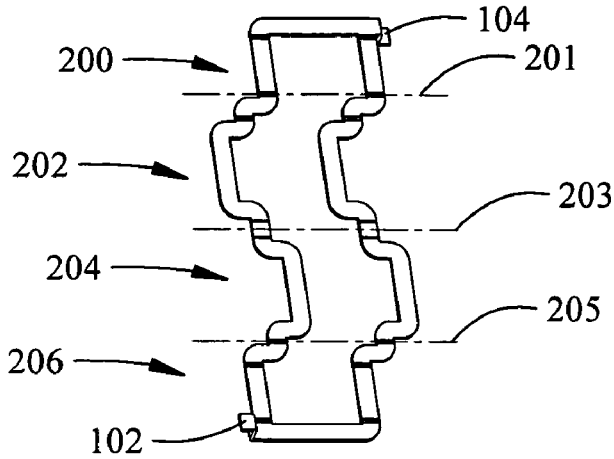
Figure 2B:
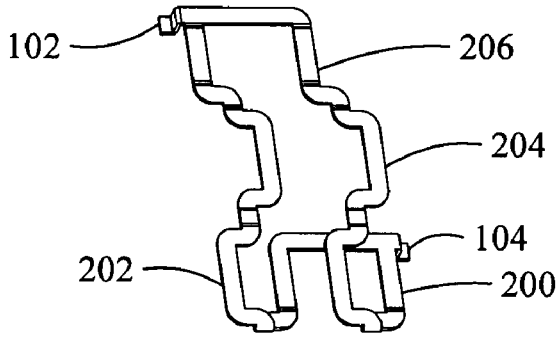
Figure 2C:
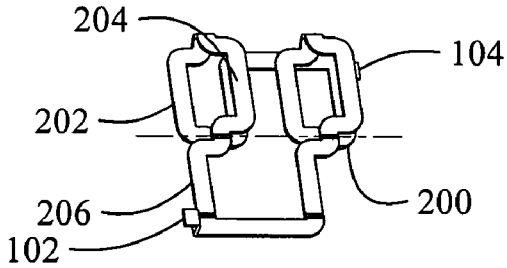

The loop 100 may be configured into a winding using the folding steps illustrated in FIGS. 2A-D. As illustrated in FIG. 2A, the loop includes four sections, 200, 202, 204 and 206 wherein each section is generally bounded by lines 201, 203 and 205. In the first folding step, illustrated in FIG. 2B, the sections 202, 204 and 206 are folded over section 200. In the second folding step, illustrated in FIG. 2C, sections 204 and 206 are folded over sections 202 and 200. In the third folding step, illustrated in FIG. 2D, the section 206 is folded over the folded sections 200, 202 and 204.

Figure 2D:
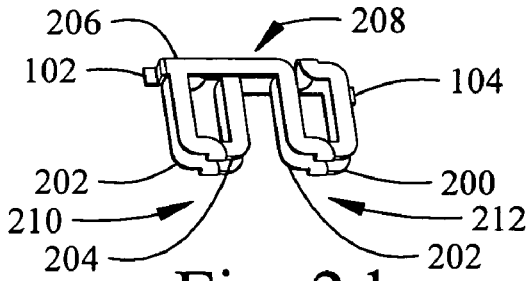

The resultant winding of FIG. 2D, shown generally as reference numeral 208 may be achieved by using the folding steps described above. However, it can be appreciated that other folding steps may be employed without departing from the scope of this disclosure.

The winding 208 in one embodiment includes a first winding 210 and a second winding 212. In addition, each winding 210 and 212 advantageously includes two turns configured from a loop of electrically conductive material.

While the winding 208 includes first and second windings 210 and 212, it should be understood that the winding 208 may include more than two windings without departing from the scope of this disclosure. Furthermore, each winding 210 and 212 may include more or fewer than two turns without departing from the scope of this disclosure.

Figure 3:
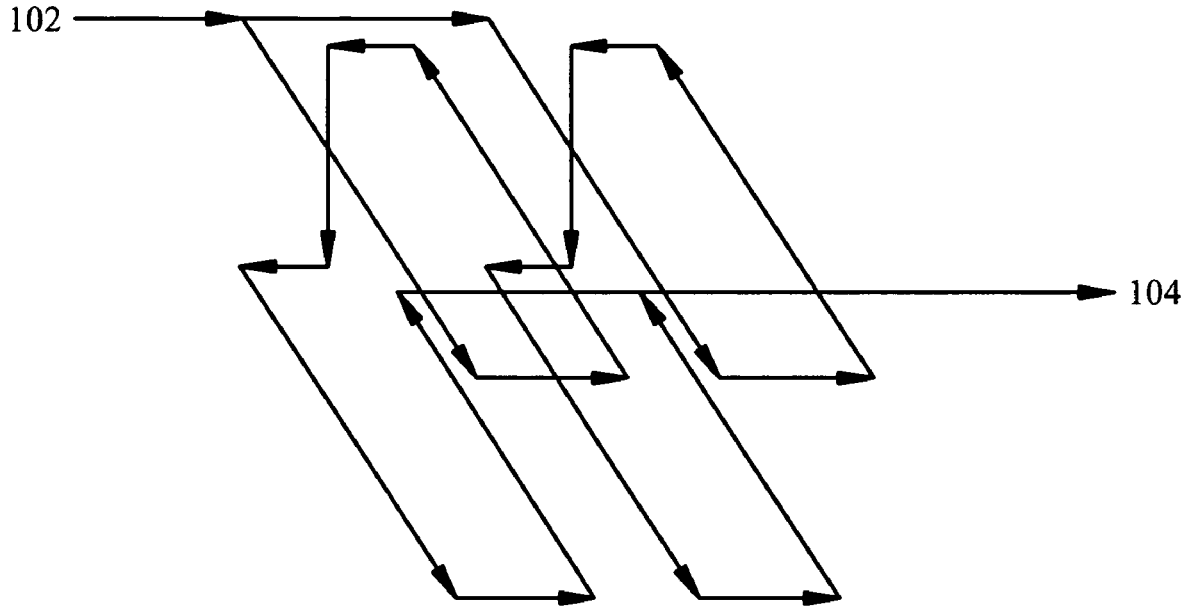
FIG. 3 is a graphic illustration of a flow of current through the winding of FIG. 2D.

The winding 208 may be arranged in one embodiment such that current in the winding flows in a parallel configuration. FIG. 3 graphically illustrates the path of current through the winding 208 from tab 102 to 104.

The electrically conductive material of the loop 100 preferably is copper. However, it should be understood that the electrically conductive material may be other materials, including other metals that are capable of conducting electricity.

Although FIG. 1 illustrates the loop 100 as generally rectangular, the present disclosure is not limited to this shape. For example, the loop 100 may have a circular shape, the shape of a square, or other shapes without departing from the scope of this disclosure.

The tabs 102 and 104 may be formed on a portion of the loop 100 and employed for a variety of purposes including serving as an electrical contact for electrically coupling the loop 100 (after being configured into a winding) to another winding. For example, the loop 100 may be configured into a secondary winding and then electrically coupled to a primary winding by way of tabs 102 and 104. In other embodiments, the loop 100 may include more or fewer than two tabs, or may include no tabs at all.

Figure 4:
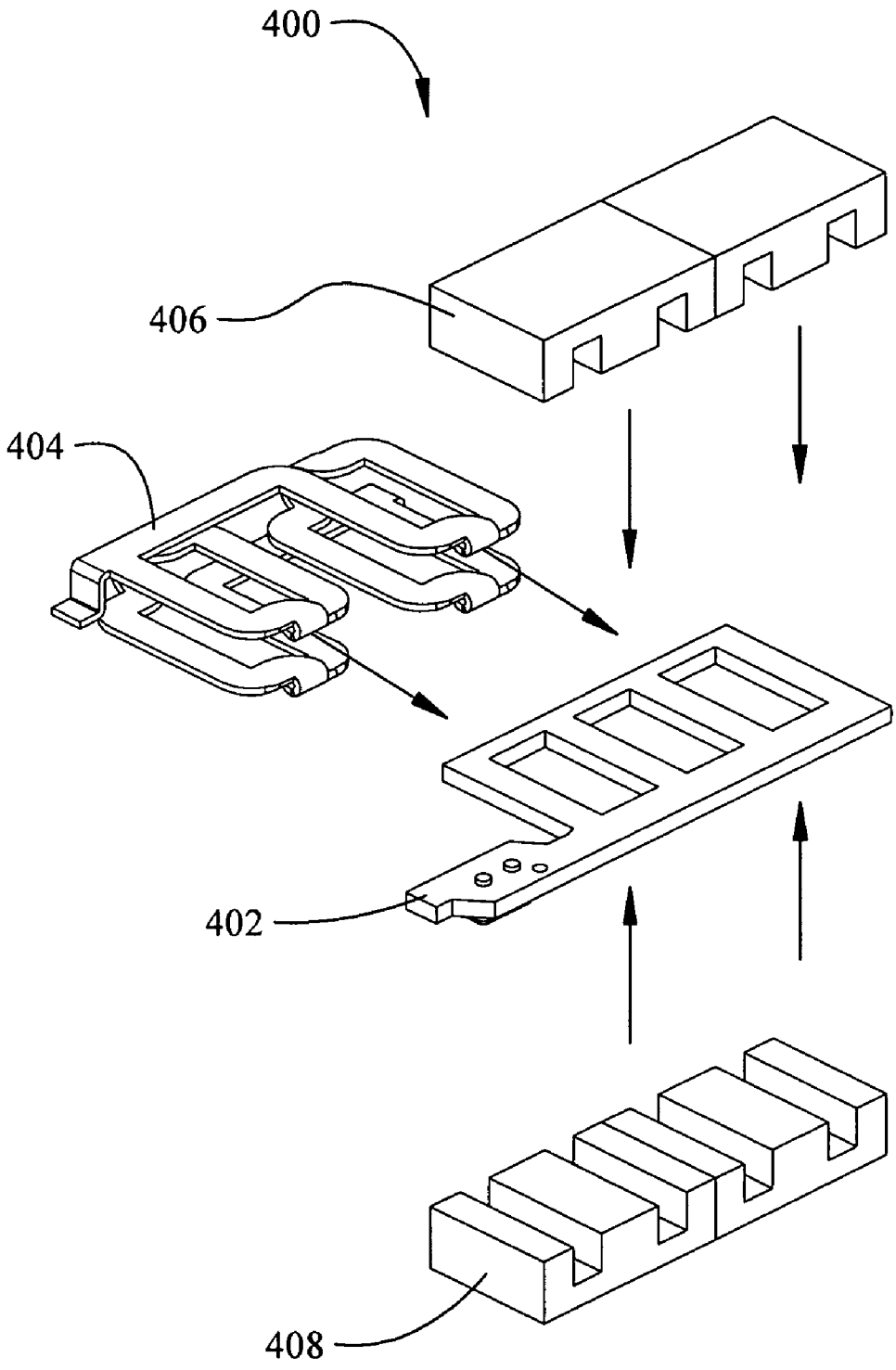
FIG. 4 is an exploded perspective view of a transformer in accordance with another embodiment of the present disclosure.

FIG. 4 is an exploded perspective view of a planar matrix transformer 400 according to another embodiment of the present disclosure. The transformer 400 includes a primary winding 402 formed on layers of printed circuit board (PCB). A preferred primary winding 402 may be formed as taught by co-pending U.S. patent application Ser. No. 10/837,398, entitled Low Noise Planar Transformer, the entire disclosure of which is incorporated herein by reference. The transformer 400 further includes a secondary winding 404 and cores 406 and 408. The secondary winding 404 may be configured from a loop of electrically conductive material as described above, or other suitable loops may also be used. In some embodiments, the secondary winding 404 employs the loop described above with reference to FIGS. 1-3. The primary and secondary winding together form a part of the planar matrix transformer 400.

Figure 5:
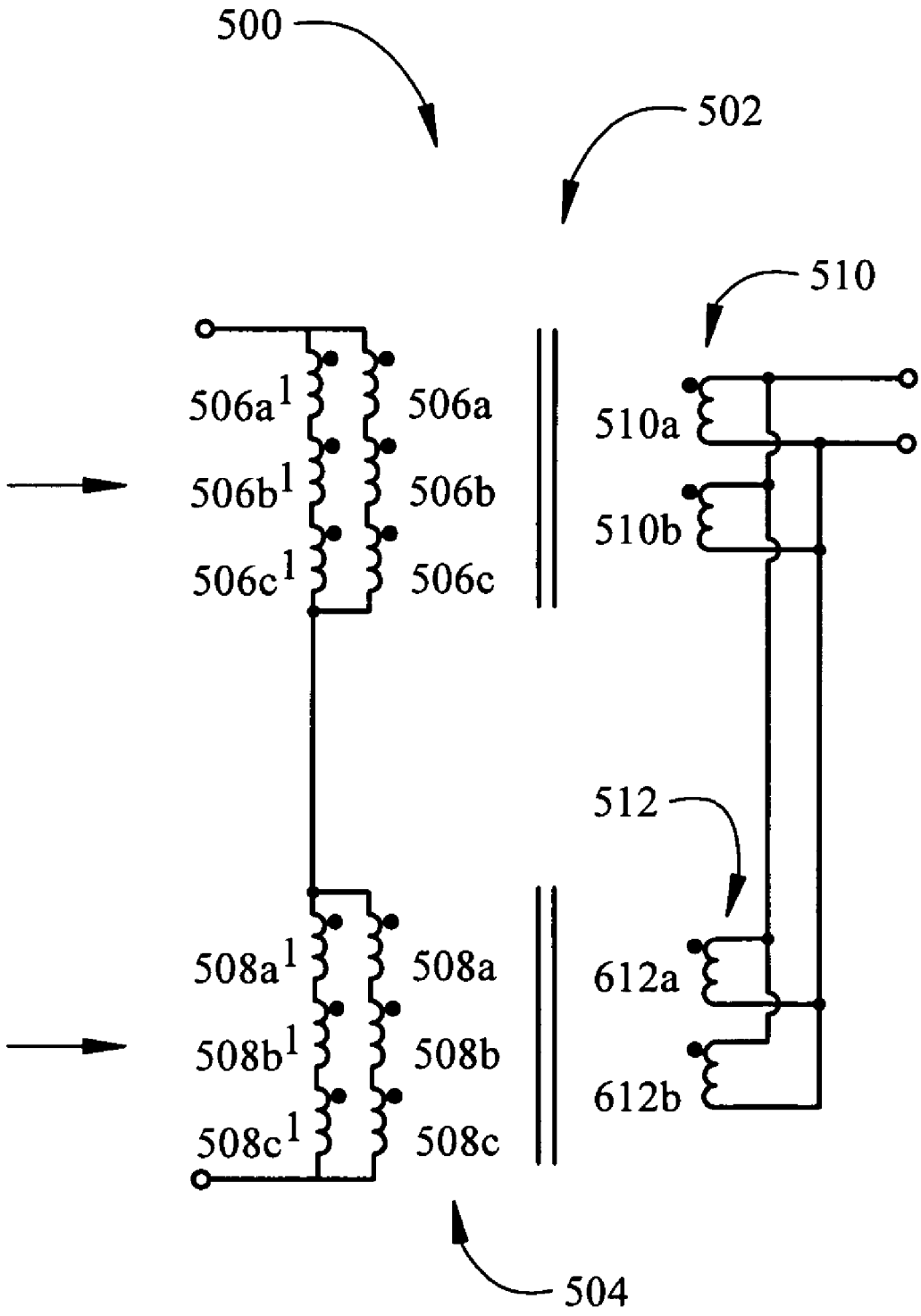
FIG. 5 is a circuit diagram of the transformer of FIG. 4.

An exemplary circuit diagram of the transformer 400 is illustrated in FIG. 5 and indicated generally by reference numeral 500. Specifically, the transformer 500 includes a first transformer 502 and a second transformer 504. Each transformer 502 and 504 includes a primary winding 506 and 508, respectively. Thus, the transformer 500 includes two primary windings. In other embodiments, however, the transformer 500 may include more than two primary windings without departing from the scope of this disclosure.

The primary winding 506 includes windings 506*a*, 506*b* and 506*c* and arranged in parallel with windings 506*a*', 506*b*' and 506*c*'. Further, the primary winding 508 includes windings 508*a*, 508*b* and 508*c* arranged in parallel with windings 508*a*', 508*b*' and 508*c*'. The primary windings 506 and 508 correspond to the primary winding 402 of FIG. 4.

Each transformer 502 and 504 also includes secondary windings 510 and 512, which are coupled to the primary windings 506 and 508, respectively. The secondary winding 510 includes windings 510*a* and 510*b* connected in parallel, and the secondary winding 512 includes windings 512*a* and 512*b* connected in parallel. The secondary windings 510 and 512 correspond to the secondary winding 402 of FIG. 4.

Figure 6A:
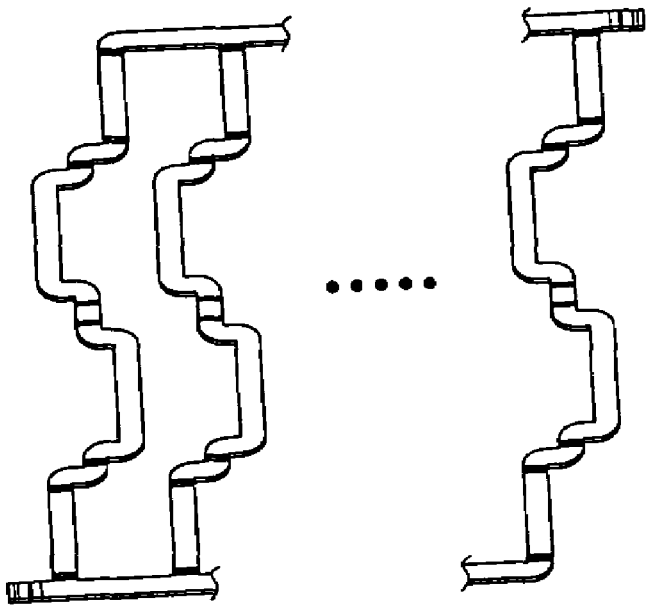
FIG. 6A is a perspective view of N−1 loops of electrically conductive material.

FIG. 6A illustrates N−1 loops of electrically conductive material, according to another embodiment of the present disclosure. N is an integer greater than one and each of the N−1 loops may be a loop as described above, or other suitable loops.

Figure 6B:
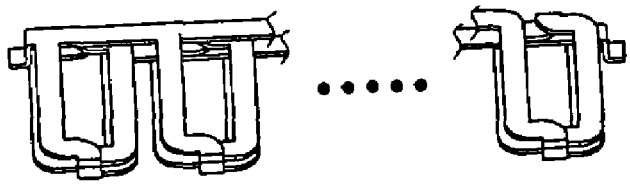
FIG. 6B is a perspective view of N windings configured from N−1 loops of electrically conductive material.

FIG. 6B illustrates the N−1 loops of electrically conductive material configured into N windings.

Referring back to FIG. 4, although the primary winding is formed on PCB, thus making it a planar transformer, it should be understood that the present invention is not so limited. For example, various embodiments of the loop described above may be employed in matrix transformers, or conventional transformers having single cores, as well as transformers not having PCB windings.

Furthermore, transformers employing the various embodiments of the loop described above may have several applications including DC-to-DC, AC-to-AC and AC-to-DC power converters. Furthermore, these transformers may be used in low profile power converters.

What is claimed is:

1. A transformer comprising:

at least two windings; and wherein each said winding has at least one turn, the windings are configured from a jointless loop of electrically conductive material.

2. The transformer of claim 1 wherein the transformer comprises a primary winding and a secondary winding, the secondary winding coupled to the primary winding.

3. The transformer of claim 2 wherein the secondary winding is configured from said loop of electrically conductive material.

4. The transformer of claim 3 wherein each said winding includes at least two turns.

5. The transformer of claim 4 wherein the secondary winding has a parallel configuration.

6. The transformer of claim 5 wherein the primary winding comprises a plurality of primary windings.

7. The transformer of claim 6 wherein the plurality of primary windings comprises two primary windings.

8. The transformer of claim 1 wherein the electrically conductive material is copper.

9. The transformer of claim 1 wherein the transformer includes N windings configured from N−1 jointless loops of electrically conductive material, where N is an integer greater than one.

10. A matrix transformer comprising:

a primary winding;

a secondary winding; and at least one of the windings configured from a single jointless loop of electrically conductive material.

11. The matrix transformer of claim 10 wherein the secondary winding is configured from a single loop of electrically conductive material.

12. The matrix transformer of claim 11 wherein the secondary winding comprises a plurality of windings.

13. The matrix transformer of claim 12 wherein the plurality of windings includes a first winding and a second winding.

14. The matrix transformer of claim 13 wherein the first winding and the second winding each include at least two turns.

15. The matrix transformer of claim 14 wherein the secondary winding has a parallel configuration.

16. The matrix transformer of claim 15 wherein the matrix transformer is a planar transformer and the primary winding is formed on printed a circuit board.

17. A power converter comprising the matrix transformer of claim 1.

18. A method of making a winding for a matrix transformer, the method comprising:

providing a jointless loop of electrically conductive material; and folding the loop to form at least two windings for a matrix transformer.

19. The method of claim 18 wherein folding includes at least three folding steps.

20. The method of claim 19 wherein folding includes folding the loop to create at least two windings.

21. The method of claim 20 wherein each of the windings includes at least two turns.

22. The method of claim 21 wherein the secondary winding has a parallel configuration.

* * * * *

UNITED STATES PATENT AND TRADEMARK OFFICE

CERTIFICATE OF CORRECTION

PATENT NO. : 7,479,863 B2
APPLICATION NO. : 11/396425
DATED : January 20, 2009
INVENTOR(S) : Chi Kit Chow, Wing Chi So and Chung Hang Lai It is certified that error appears in the above-identified patent and that said Letters Patent is hereby corrected as shown below:

Item 12 on the Title page, delete "Kit et al." and replace with -- Chow et al --.

On the Title page, at identifier (75), delete:

"Checky Chow Chi Kit, Hong Kong (HK); Kelvin So Wing Chi, Hong Kong (HK); Francois Lai Chung Hang, Hong Kong (HK)"

and replace with:

--Chi Kit Chow, Hong Kong (HK); Wing Chi So, Hong Kong (HK); Chung Hang Lai, Hong Kong (HK)--.

Signed and Sealed this

Seventeenth Day of March, 2009

John Doll

JOHN DOLL
*Acting Director of the United States Patent and Trademark Office*